US007111913B2

(12) United States Patent
Dubon

(10) Patent No.: US 7,111,913 B2
(45) Date of Patent: Sep. 26, 2006

(54) TELESCOPING SLIDE RAIL WITH LATCHING AND ALIGNMENT MECHANISMS

(75) Inventor: William Dubon, Bloomingdale, IL (US)

(73) Assignee: Pentair Electronic Packaging, Des Plaines, IL (US)

( * ) Notice: Subject to any disclaimer, the term of this patent is extended or adjusted under 35 U.S.C. 154(b) by 227 days.

(21) Appl. No.: 10/739,240

(22) Filed: Dec. 18, 2003

(65) Prior Publication Data

US 2004/0183410 A1 Sep. 23, 2004

Related U.S. Application Data

(60) Provisional application No. 60/434,586, filed on Dec. 18, 2002.

(51) Int. Cl.
*A47B 88/00* (2006.01)

(52) U.S. Cl. ..... 312/333

(58) Field of Classification Search ..... 312/333, 312/330.1, 334.1, 334.9, 334.7, 334.8, 334.44, 312/334.46, 334.45, 334.47; 384/20, 21, 384/22, 23

See application file for complete search history.

(56) References Cited

U.S. PATENT DOCUMENTS

| | | | | |
|---|---|---|---|---|
| 2,726,915 | A | 12/1955 | Schuette | |
| RE28,344 | E | 2/1975 | Monaco | |
| 3,912,341 | A | 10/1975 | Stein | |
| 3,975,063 | A | 8/1976 | Mahotka et al. | |
| 4,469,384 | A | 9/1984 | Fler et al. | |
| 4,537,450 | A | 8/1985 | Baxter | |
| 4,560,212 | A | 12/1985 | Papp et al. | |
| 4,662,761 | A | 5/1987 | Hoffman | |
| 4,692,035 | A | 9/1987 | Rock et al. | |
| 4,696,582 | A | 9/1987 | Kasten | |
| 4,749,242 | A * | 6/1988 | Rechberg | 312/333 |
| 4,872,734 | A * | 10/1989 | Rechberg | 312/333 |
| 4,953,990 | A | 9/1990 | Wojcik | |
| 5,255,983 | A * | 10/1993 | Parvin | 384/21 |
| 5,484,197 | A | 1/1996 | Hansen et al. | |
| 5,551,775 | A | 9/1996 | Parvin | |
| 5,871,265 | A | 2/1999 | Stewart et al. | |
| 6,224,177 | B1 * | 5/2001 | Chu | 312/334.1 |
| 6,238,031 | B1 | 5/2001 | Weng | |
| 6,254,209 | B1 | 7/2001 | Parvin | |
| 6,254,210 | B1 | 7/2001 | Parvin | |
| 6,296,338 | B1 * | 10/2001 | Stijns | 312/333 |
| 6,379,045 | B1 | 4/2002 | Cirocco | |
| 6,588,866 | B1 | 7/2003 | Cheng | |
| 6,601,933 | B1 | 8/2003 | Greenwald | |
| 6,729,703 | B1 * | 5/2004 | Le | 312/333 |
| 6,749,276 | B1 * | 6/2004 | Judge et al. | 312/334.47 |
| 6,796,625 | B1 * | 9/2004 | Lauchner et al. | 312/334.46 |
| 6,805,418 | B1 * | 10/2004 | Milligan | 312/333 |
| 2001/0037985 | A1 | 11/2001 | Varghese et al. | |
| 2002/0050773 | A1 | 5/2002 | Reis | |
| 2003/0052580 | A1 | 3/2003 | Dobler et al. | |

* cited by examiner

*Primary Examiner*—Janet M. Wilkens
*Assistant Examiner*—Timothy Ayres
(74) *Attorney, Agent, or Firm*—Vedder Price Kaufman & Kammholz

(57) ABSTRACT

A telescoping slide rail assembly including interconnected mounting, intermediate and stationary slide rails movable relative to one another to extend and retract the mounting and intermediate slide rails relative to the stationary slide rail between fully extended and retracted positions. The intermediate slide rail includes a latching mechanism for interconnecting the intermediate and stationary slide rails in the fully extended position and the mounting slide rail includes an alignment device to maintain orientation between the mounting slide rail and the intermediate slide rail.

9 Claims, 8 Drawing Sheets

TELESCOPING SLIDE RAIL WITH LATCHING AND ALIGNMENT MECHANISMS

This application claims priority under 35 U.S.C. § 119(e) to U.S. provisional application Ser. No. 60/434,586, filed Dec. 18, 2002, which is expressly incorporated by reference herein.

BACKGROUND OF THE INVENTION

This invention pertains to a telescoping slide rail assembly for mounting components within a telecommunications rack, and more particularly, to a latching mechanism and alignment device used in connection with the telescoping slide assembly for use in the telecommunications industry.

There are numerous prior art telescoping slide rail devices for mounting telecommunications equipment and other various components. One major disadvantage of these prior art telescoping slide rail assemblies is that the latching mechanisms which orient and connect the intermediate slide rail to the stationary slide rail in a fully extended position are complex in design and relatively expensive to manufacture and install.

Another major disadvantage of these prior art telescoping slide rail assemblies is that manufacturing and assembly tolerances of the intermediate slide rail and the mounting slide rail are comparatively large and permit unwanted relative movement therebetween. As a result, there is a large tolerance variance between adjacent, parallel, offset pairs of telescoping slide assemblies. Consequently, the mounting slide rail is loosely disposed within the intermediate slide rail. Unwanted movement causes contact between the intermediate and mounting slide rails and friction therebetween is increased.

Therefore, there is a need for a latching mechanism which is inexpensive, easy to manufacture and install and simple and reliable to operate. There is also a further need for an improved alignment device which orients the slide rails, minimizes friction between the sliding rails and compensates for manufacturing tolerances.

BRIEF DESCRIPTION OF THE DRAWINGS

The invention may best be understood by reference to the following description taken in conjunction with the accompanying drawings, in the several figures of which like reference numerals identify like elements.

DETAILED DESCRIPTION OF A PREFERRED EMBODIMENT OF THE INVENTION

Figure 1:
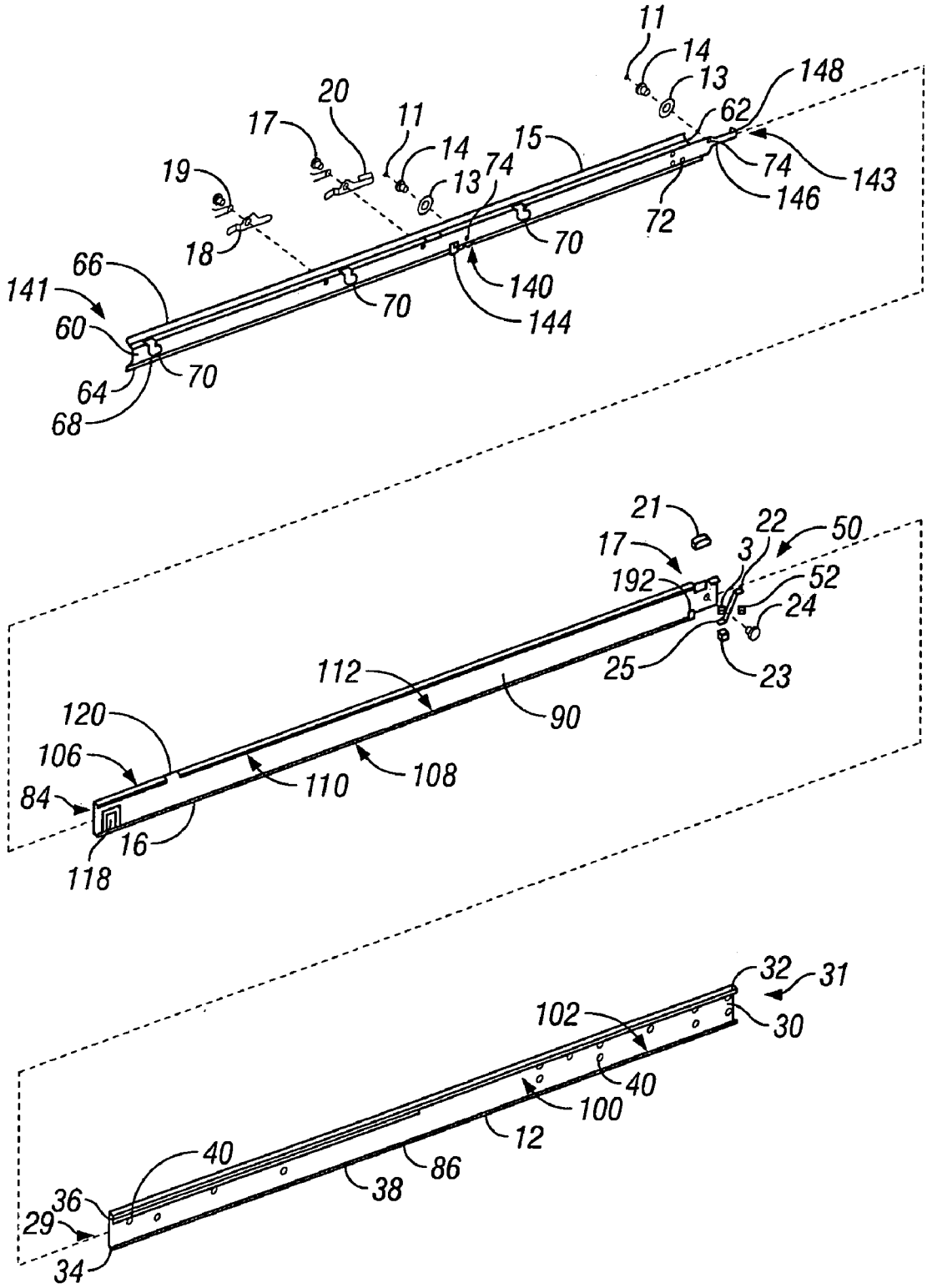
FIG. 1 is an exploded perspective view of a telescoping slide rail assembly in accordance with one embodiment of the present invention.

FIG. 1 is an exploded view of the improved telescoping slide rail assembly of the present invention. Generally, the telescoping slide rail assembly includes a stationary slide rail 12, intermediate slide rail 16 and mounting slide rail 15.

The stationary slide rail 12, as will be described in more detail below, includes a wall 30, a top flange 32, a bottom flange 34, a top lip 36 and a bottom lip 38. A bracket may be connected to the wall 30 adjacent an inner end 31 of the stationary slide rail 12 by fasteners which extend through holes 40 defined in the wall 30. Another bracket may be connected to the wall 30 adjacent an outer end 29 of the stationary slide rail 12 by fasteners which extend through holes 40. The brackets are useful for mounting or connecting the stationary slide rail 12 to a support. However, it will be recognized by one of skill in the art that the stationary slide rail may be mounted or connected to a support with or without any brackets in any suitable manner.

The wall 30, upper flange 32 and upper lip 36 cooperatively define an upper channel 100. The wall 30, lower flange 34 and lower lip 38 cooperatively define a lower channel 102. The upper and lower channels 100, 102 are configured to receive the intermediate slide rail 16 in a nesting relationship for relative movement therebetween as described herein. A retraction stop 104 (see FIGS. 4 and 5) is formed in the lower flange 34 adjacent an inner end 31 of the stationary slide rail 12 for orienting the intermediate slide rail 16 in a fully retracted orientation. A slot 86 is defined in the lower lip 38 for operative engagement with an interlock of the latch mechanism as described herein.

The intermediate slide rail 16, as will be described in more detail below, includes one embodiment of a latch mechanism 50, including an arm 22 which is connected at a mount portion to an inner end 17 of the intermediate slide rail 16 by a fastener 52. An interlock 23 is connected to a free end 25 of the arm 22 by a fastener 3. A stop pivot 24 is connected to the intermediate slide rail 16 for operative contact with the arm 22 in order to enable disconnection of the intermediate slide rail 16 and stationary slide rail 12, as will be discussed in more detail herein. A slide block 21 is connected to the intermediate slide rail 16 adjacent an inner end 17 for reducing friction between the intermediate and stationary slide rail 16, 12 during relative movement. It is within the teachings of the present invention that the arm 22 may be formed from a material suitable for the arm 22 to function as a biasing element. For example, the arm 22 may be formed from any resilient metallic, plastic, natural, synthetic or other suitable material which permits the arm 22 to function to not only position and orient the interlock, but also as a biasing element.

Figure 4:
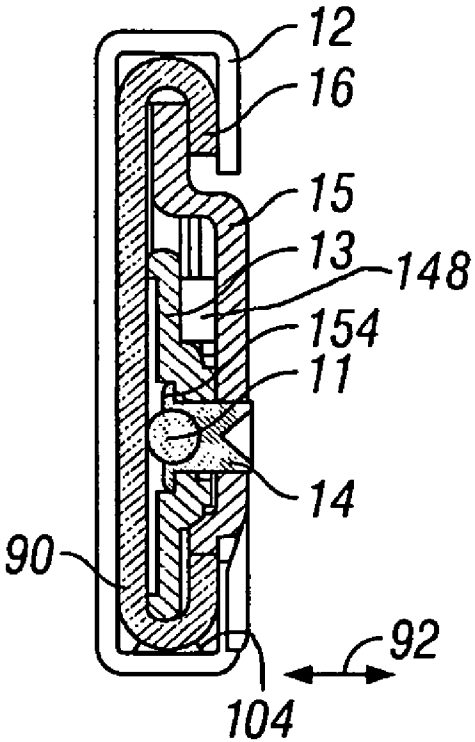
FIG. 4 is a cross-sectional view of the telescoping slide rail assembly of FIG. 1 taken along line 4—4 in FIG. 2.

The intermediate slide rail 16 includes a wall 90, an upper element 106 and a lower element 108. The wall 90 and upper element 106 cooperatively define an upper guide 110. The wall 90 and the lower element 108 cooperatively define a lower guide 112. The upper and lower guides 110, 112, engage the mounting slide rail 15 in a nesting relationship as shown in FIG. 4. The lower element 108 has an inner flange 192 disposed to engage the interlock as will be discussed below.

The inner end 17 of the intermediate slide rail 16 is illustrated in detail in FIGS. 6–9. A flange 114 is formed at the inner end 17 to provide a mounting point for the latch mechanism 50. A stop pivot 24 is connected to the intermediate slide rail 16 in any suitable conventional manner. A tab 94 is formed adjacent the stop pivot 24 to confine a portion of the arm 22 between the tab 94 and the stop pivot 24. A tab 116 (see FIGS. 5 and 6) is defined on the intermediate slide rail 16 adjacent the flange 114 (see FIG. 6) for engaging the slide block 21 in order to orient the slide block 21 in operation. An extension stop 118 is formed in the wall 90 of the intermediate slide rail 16 adjacent the outer end 84 for operatively engaging the mounting slide rail 15 as discussed herein. A slot 120 is defined in the upper element 106 for a passageway to facilitate a component (not shown) to engage the mounting slots 70, as described in more detail in U.S. Pat. application Ser. No. 10/318,850, incorporated fully herein.

The mounting slide rail 15, as will be discussed in more detail below, includes a wall 60, a top flange 62, a bottom flange 64, a top lip 66 and a bottom lip 68. A plurality of slots 70 are defined in the top flange 62 and wall 60 which preferably, operatively engage mounting posts disposed on a component for mounting hereto. Another bracket may be connected to an inner end 17 of the mounting slide rail 15 via fasteners which engage holes 72.

A pair of rollers 13 are connected to the wall 60 by hubs 14 which engage holes 74 in a conventional manner which may include a press fit, fastener or other suitable mechanical connection including bonding, welding, adhering or in any other suitable manner. A bearing 11 is disposed within the free end enlarged head element of the hub 14, as will be discussed in more detail herein. Preferably, the bearing 11 is retained within the hub 14. It is within the teachings of the present invention that the bearing may be in ball bearing, fixed bearing or any other suitable bearing element. It will be recognized by those of skill in the art that the bearing may be configured in any suitable shape and from any suitable material such as any metallic, plastic, synthetic, composite or any other suitable material.

A mounting post engaging latch 18 is connected to the wall 60 and biased into position by spring 19. A mounting slide rail retraction stop 20 is connected to the wall 60 by fastener 17. A spring may be provided to bias the retraction stop 20 into a position to engage the outer end 84 of the intermediate slide rail 16.

A notch 140 is formed in the lower flange and lip 64, 68 to provide clearance for the roller 13 secured to hole 74. A tab 144 is formed in the lower lip and flange 68, 64 and the wall 60 for engaging the extension stop 118 formed on the intermediate slide rail 16 in order to prevent the mounting slide rail 15 from disconnection with the intermediate slide rail 16. A tongue 146 is defined at the inner end 143 of the mounting slide rail 15. The tongue 146 has a tab 148 formed at the distal end thereof for engaging a bearing portion of the arm 22 of the latch mechanism 50 to enable disengagement of the intermediate slide rail 16 from the stationary slide rail 12 for retraction of the intermediate slide rail 16, as will be described in detail herein.

Figure 2:
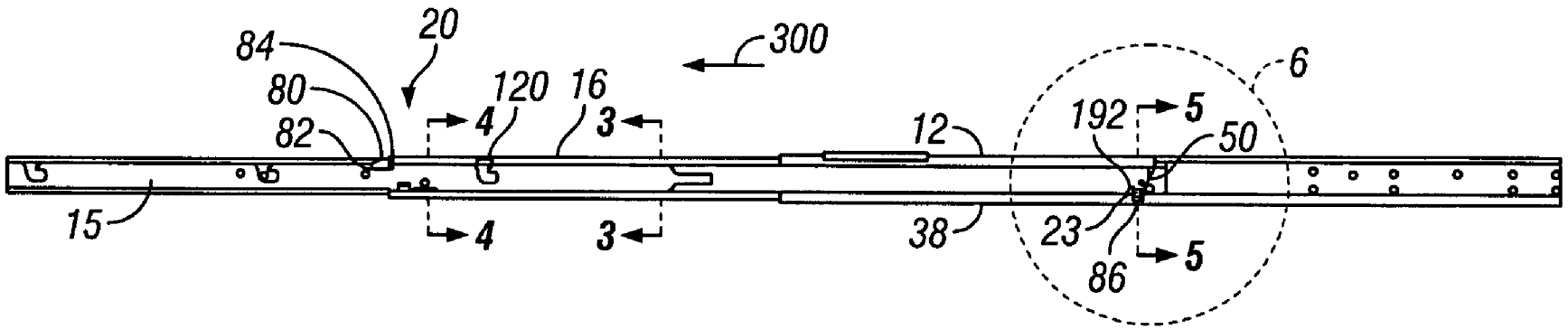
FIG. 2 is an elevation view of the one side of a telescoping slide rail assembly of FIG. 1.

FIG. 2 illustrates an elevation view of one embodiment of the telescoping slide rail assembly of the present invention assembled and disposed in a fully extended orientation. A flange 80 of the retraction stop 20 extends through a slot 82 formed in the mounting slide rail 15 to engage an outer end 84 of the intermediate slide rail 16 to prevent unintended retraction of the mounting slide rail 15. Movement of the retraction stop handle against the spring bias moves the flange 80 to another operative position out of engagement with the outer end 84 in order to enable retraction of the mounting slide rail 15 within the intermediate slide rail 16.

The interlock 23 of the latch mechanism 50 engages a first opening 86 formed in the lip 38 of the stationary slide rail 12 to lock the intermediate slide rail 16 in a fully extended position with respect to the stationary slide rail 12. The retraction stop 20 and mounting post engaging latch 18 are connected to the mounting slide rail 15 such that each respective handle is available for operative movement by a user when the mounting slide rail is disposed in the fully extended position as is described in more detail in U.S. patent application Ser. No. 10/318,850 incorporated fully herein.

Figure 3:
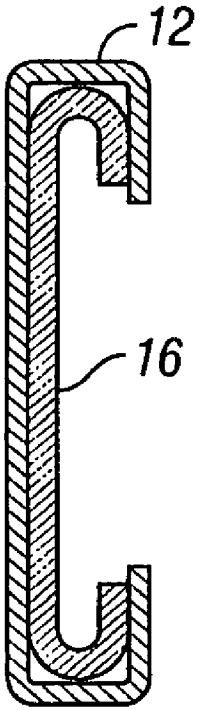
FIG. 3 is a cross-sectional view of the telescoping slide rail assembly of FIG. 1 taken along line 3—3 in FIG. 2.

FIG. 3 is a cross-sectional view taken along line 3—3 in FIG. 2, which illustrates the stationary slide rail 12 and the intermediate slide rail 16 disposed in a nesting relationship.

FIG. 4 is a cross-sectional view taken along line 4—4 in FIG. 2, which illustrates the mounting slide rail 15 in a nesting relationship with intermediate slide rail 16, which is in a nesting relationship with the stationary slide rail 12. Roller 13 is connected to the mounting slide rail 15 by a hub 14. A bearing 11 is disposed in an enlarged head element 154 free end of the hub 14. Bearing 11 is disposed such that a portion is immediately adjacent an inner surface of wall 90 of the intermediate slide rail 16 so that minimal lateral movement in the directions of arrow 92 is permitted.

Figure 10:
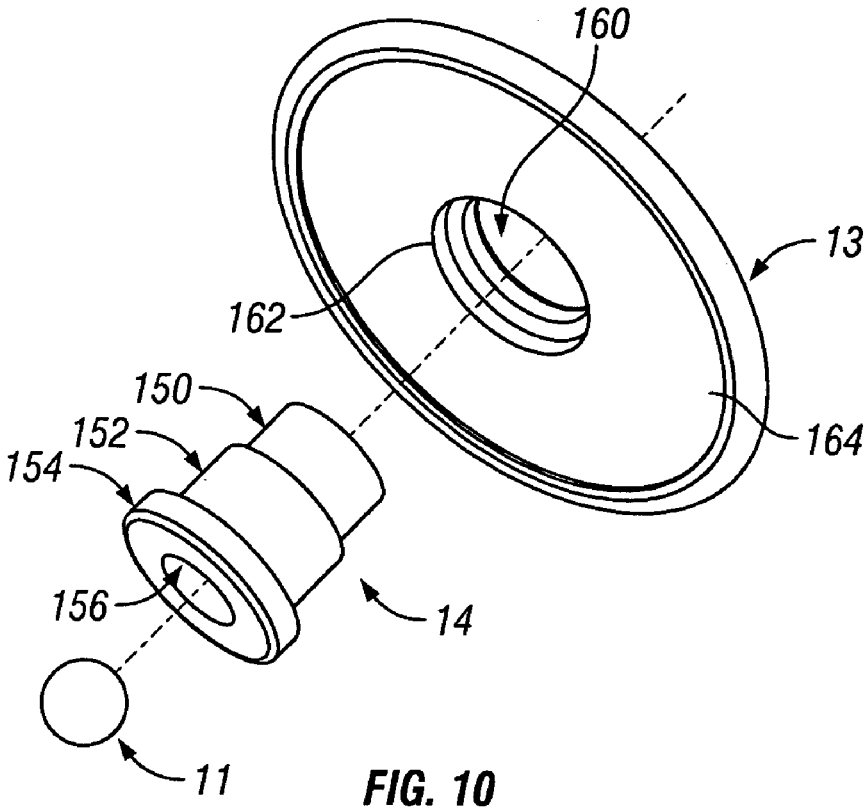
FIG. 10 is an exploded detailed view of a roller including an alignment device in accordance with one embodiment of the present invention.
Figure 11:
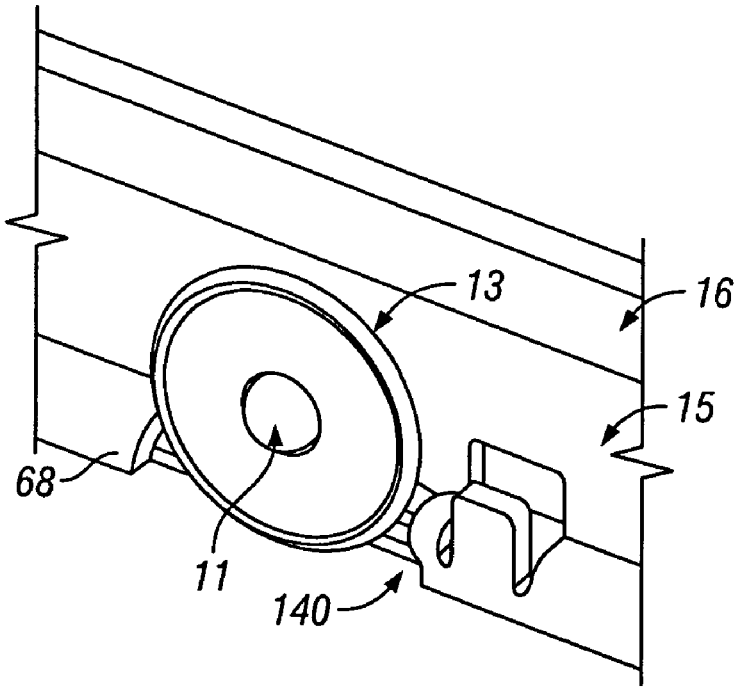
FIG. 11 is a broken away detailed view of the roller and alignment device of FIG. 10 as installed.

FIGS. 10 and 11 illustrate the improved roller and hub 13, 14 of the present invention. The hub 14 includes a mounting element 150, a support element 152, an enlarged head element 154 and a receptacle 156. The mounting element 150 engages one of the holes 74 (see FIG. 1) to connect the roller 13 to the mounting slide rail 15. The support element 152 supports the roller 13 for relative rotational movement when the mounting slide rail 15 is moved relative to the intermediate slide rail 16. The enlarged head element 154 retains the roller 13 connected to the mounting slide rail and to a certain degree prevents unwanted lateral movement of the roller 13 in the direction of arrow 92 with respect to the mounting slide rail 15. The receptacle 156 is configured to receive and retain the bearing 11.

The roller 13 includes an opening 160 which is configured to receive the hub 14. A first portion 162 of the opening 160 is configured to receive the enlarged head element 154. A recessed face 164 is formed in the roller 13 to reduce rolling friction with respect to an adjacent wall of the intermediate slide rail 16.

Figure 5:
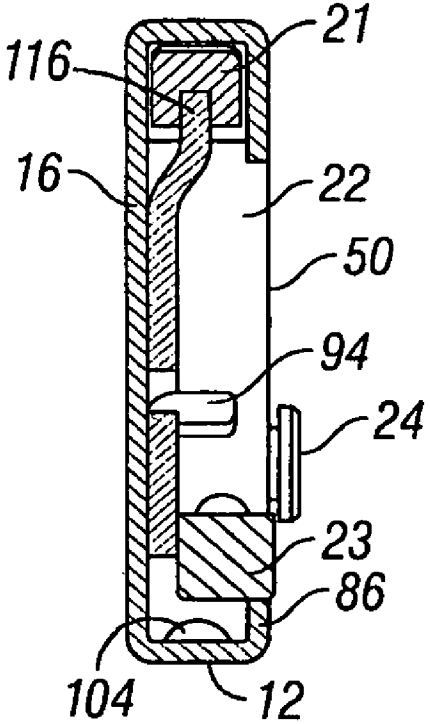
FIG. 5 is a cross-sectional view of the telescoping slide rail assembly of FIG. 1 taken along line 5—5 in FIG. 2.

FIG. 5 is a cross-sectional view taken along line 5—5 in FIG. 2, which shows one embodiment of the latch mechanism 50 including the interlock 23 disposed within the first opening 86 formed in the stationary slide rail 12. Stop pivot 24 and tab 94 cooperatively retain the arm 22 therebetween and confine movement of the arm 22 during release of the interlock 23 from the first opening 86 as will be discussed in detail below. The slide block 21 is connected to an upper tab portion 116 of the intermediate slide rail 16 and functions to stabilize the intermediate slide rail 16 at the inner end 17 thereof and to reduce friction between the intermediate and stationary slide rails 16, 12.

FIGS. 6–9 illustrate the structural and functional aspects of one embodiment of the latch mechanism 50 of the present invention. The arm 22 is preferably configured from spring steel. However, it is within the teachings of the present invention that any suitable resilient material may be substituted therefor. For example, any resilient synthetic or natural material, plastic or any other suitable resilient material may be used. Arm 22 includes a main element 124 having a bearing portion 123 defined thereon and a pair of mirror image opposed ends 26, 28. A hole is formed in each of the ends 26, 28 for engaging a fastener 52, 3 to connect the arm 22 to the flange 114 at the mount portion of the interlock 23. One advantage of the present invention is that it is irrelevant which opposing end 26, 28 is attached to the flange 114 or the interlock 23. As a result, manufacture and installation are greatly simplified.

The stop pivot 24 includes a mounting portion, a bearing portion (134, see FIG. 5) and an enlarged head portion 136. The main element 124 of the arm 22 contacts the bearing portion 134 when the arm 22 is deflected as a result of contact between an inner end 143 of the mounting slide rail 15 and the bearing portion 123 of the main element 124, as will be discussed in detail herein. The stop pivot mounting portion engages a hole defined in the intermediate slide rail 16 for connection thereto in a conventional manner.

The interlock 23, in one embodiment of the present invention, is generally configured as a block for engaging the first opening 86 formed in the stationary slide rail 12, the lower lip 38 and the inner flange 192, which defines a second opening 87, to prevent relative movement between the intermediate and stationary slide rails 16, 12. The first opening 86 and inner flange 192, which defines the second opening 87, cooperatively engage opposing sides of the interlock 23 in order to prevent retracting movement of the intermediate slide rail 16 from the fully extended position. It is within the teachings of the present invention that the interlock 23 may be configured in a suitable shape to provide the intended function and from any suitable material for an intended application.

FIGS. 12–15 illustrate the structural and functional aspects of another embodiment of the latch mechanism 50 of the present invention. The arm 22 is preferably configured from a metallic material. However, it is within the teachings of the present invention that any suitable metallic, plastic, synthetic or natural material may be used.

Arm 22 includes a generally centrally disposed mount portion 150 and an interlock 23 disposed at an outer end of the arm 22 and a flange 152 disposed at an inner end of the arm 22, defining a bearing portion 123, both the interlock 23 and the flange 152 extending from the mount portion 150. In this embodiment of the present invention the mount portion 150 is configured generally tubular such that a pin 156 passing therethrough along a longitudinal axis or engaging openings at opposite ends of the mount portion 150 aligned on the longitudinal axis enables the mount portion 150 to move about the pin 156. The arm 22 may also then be connected to the intermediate slide rail 16.

The interlock 23 in this embodiment of the present invention is generally configured as a hooked finger 158 extending away from the mount portion 150 in the direction of the mounting slide rail 15. The interlock 23 preferably bends back generally toward the mount portion 150 and in the direction of the wall of the intermediate slide rail 16 to form the "hooked" portion at the distal end of the interlock 23, or outer end of the arm 22, which defines a catch in the "hooked" portion. It is within the teachings of the present invention that the interlock may take any suitable form or configuration to secure the intermediate and stationery slide rails as described in more detail below.

Figure 12:
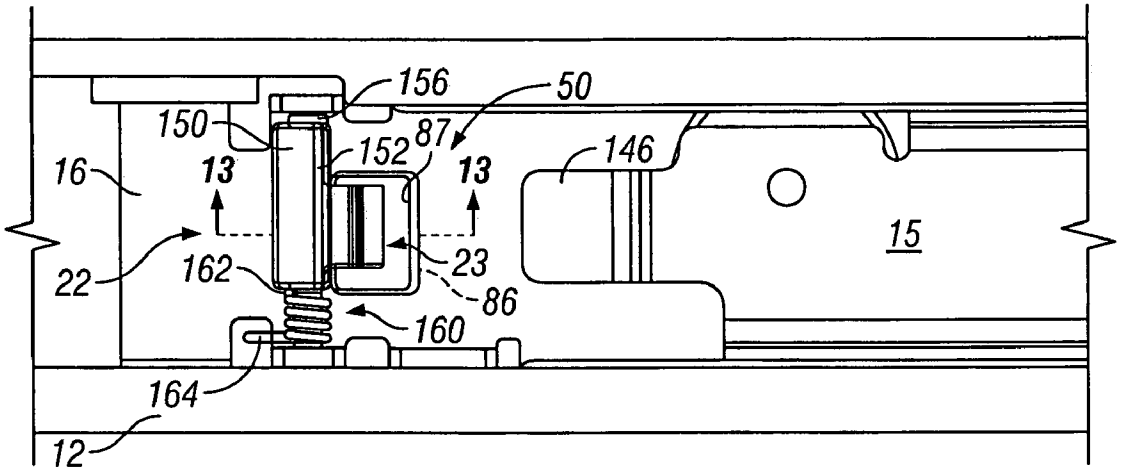
FIG. 12 is a broken away elevation view of a telescoping slide rail assembly in accordance with another embodiment of the present invention.
Figure 13:
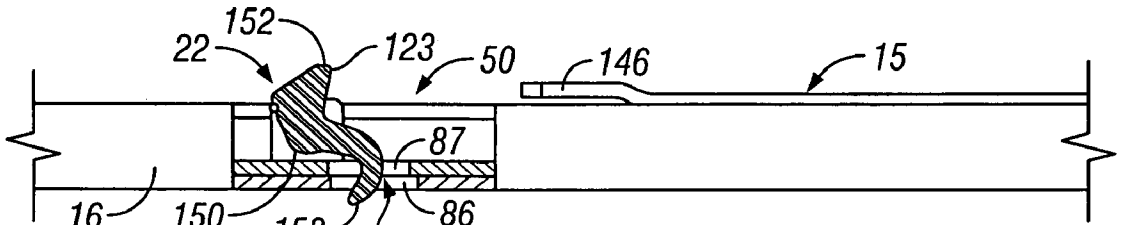
FIG. 13 is a cross-sectional view of the telescoping slide rail assembly taken along line 13—13 in FIG. 12.
Figure 14:
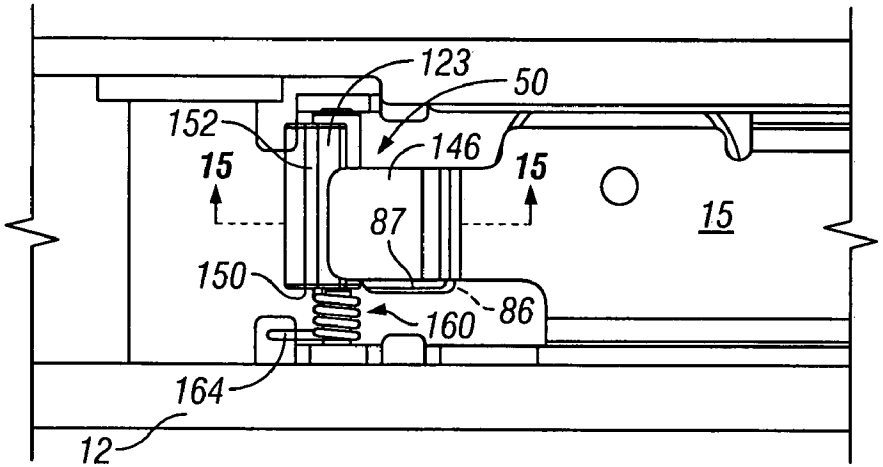
FIG. 14 is a broken away elevation view of the telescoping slide rail assembly of FIG. 12 illustrating a mounting slide rail disengaging a latch mechanism.
Figure 15:
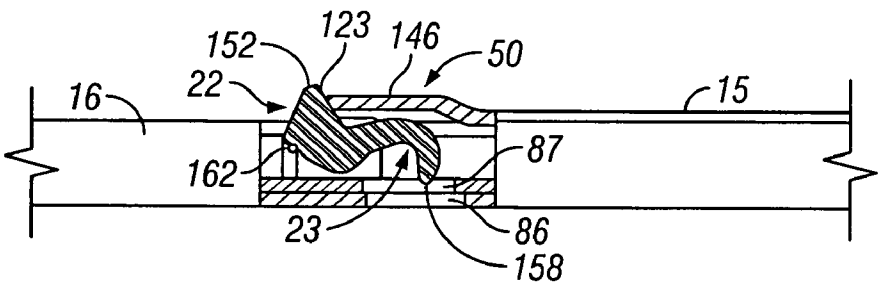
FIG. 15 is a cross-sectional view of the telescoping slide rail assembly taken along line 15—15 in FIG. 14.

The flange 152 extends away from the mount portion 150 in a generally normal orientation to the intermediate slide rail 16 when the intermediate slide rail is disposed in a fully extended position, as shown in FIGS. 12 and 13. As also shown in FIGS. 12 and 13, a front face of the flange 152 defines the bearing portion 123 which extends generally normal to the intermediate slide rail 16 beyond the wall of the mounting slide rail 15 and is disposed and oriented for contact by the free end of the tongue 146, which free end is formed offset and spaced away from the wall of the mounting slide rail 15, opposite the direction of the intermediate 16 and stationary 12 slide rails, as shown in FIGS. 14 and 15 and as will be described in more detail below.

A biasing element 160 in this embodiment of the present invention is generally configured as a coil spring bearing against a side of the flange 152 opposite the bearing portion 123 at one end 162 and against the intermediate slide rail 16 at another end 164. It is within the teachings of the present invention that any other suitable type of biasing element may be used. For example, flat springs, contour spring element and any other suitable biasing device may be used. As shown in FIGS. 12 and 13, the spring 160 biases the flange 152 in the direction of the mounting slide rail 15 such that the arm 22 rotates about the mount portion 150. As a result, the interlock 23 is continuously biased in the direction of the wall 90 of the intermediate slide rail 16.

The latch mechanism 50 further includes a first opening 86 formed in the wall 30 of the stationary slide rail 12 and a second opening 87 formed in the wall of the intermediate slide rail 16. The first and second openings 86, 87 are aligned when the intermediate slide rail 16 is disposed in a fully extended position. The interlock 23 may then engage the aligned openings 86, 87 and prevent unwanted movement of the intermediate slide rail 16 toward the fully retracted position. The spring 160 biases the arm 22 such that after disengagement of the interlock 23 from the first opening 86 and movement of the intermediate slide rail 16 toward a fully retracted position, the hooked finger 158 extends through the second opening 87 in a non-operative position sliding against the wall 30 of the stationary slide rail 12.

In operation, the telescoping slide assembly of the present invention when disposed in a fully retracted position may be moved to a fully extended position (see FIG. 2) for servicing or installing a component which may be connected to the mounting slide rail 15 as discussed in U.S. patent application Ser. No. 10/318,850 incorporated fully herein. In this process, an operator grasps the component or outer end 141 of the mounting slide rail 15 and pulls outwardly away from the support to which the telescoping slide assembly is connected, generally in the direction of arrow 300, shown in FIG. 2. The intermediate slide rail 16 also moves from a fully retracted position to a fully extended position relative to the stationary slide rail 12 which does not move relative to the support. In one embodiment of the present invention, the intermediate slide rail 16 remains in a fully retracted position, until the mounting slide rail 15 extends to the fully extended position. In another embodiment of the present invention, the mounting and intermediate slide rails 15, 16 move together as a unit from a fully retracted position. In such embodiment, the mounting slide rail 15 remains in a fully retracted position with respect to the intermediate slide rail 16 until the intermediate slide rail 16 is disposed in a fully extended position. At such time, the mounting slide rail 15 is then moved to its fully extended position.

Further discussion of the operation of the telescoping slide rail assembly of the present invention will be with reference to the first embodiment described above. However, it will be recognized by those of skill in the art that the second embodiment described above operates in the same manner, except as noted above.

In one embodiment of the present invention, when the intermediate and mounting slide rails 16, 15 are disposed in a fully retracted position, the mounting slide rail 15 may be extended from the fully retracted position to the fully extended position. The latching mechanism 50, particularly the interlock 23, is disposed in a non-operative position, either above the lower lip 38 or sliding against the wall of the stationary slide rail, and remains unassociated with the first opening 86. The mounting slide rail 15 is moved further outward in the direction of arrow 300 until disposed in a fully extended position where the flange 80 of retraction stop 20 engages slot 82 and outer end 84. The intermediate slide rail 16 is then also moved to a fully extended position where the interlock 23 engages the first opening 86 as shown in FIGS. 6, 12 and 13.

Figure 6:
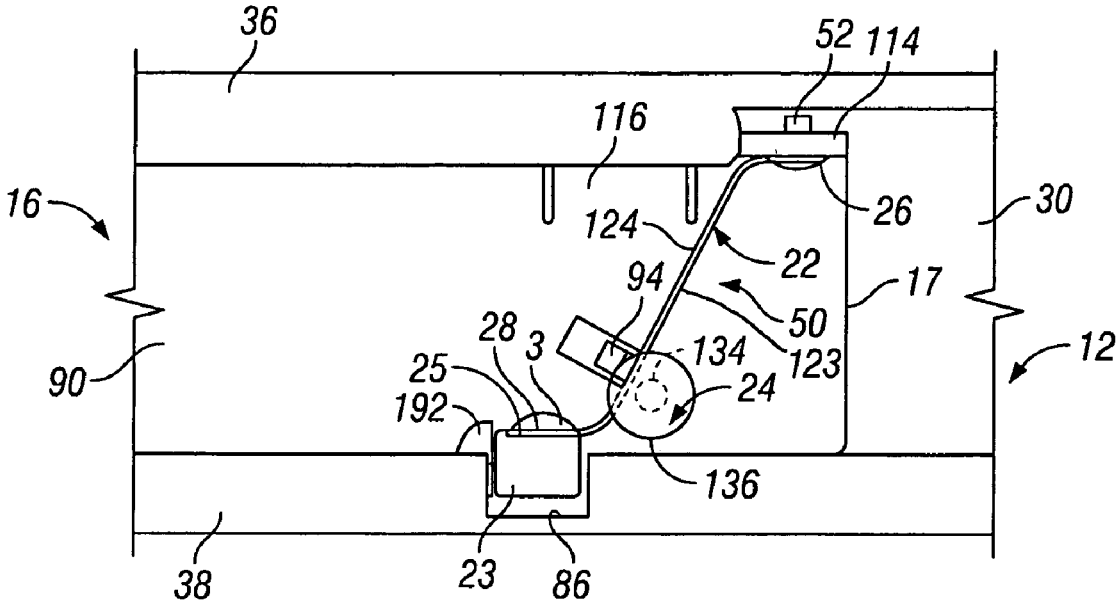
FIG. 6 is a detailed elevation view of the telescoping slide rail assembly of FIG. 1 indicated as area 6 in FIG. 2.

FIGS. 6, 12 and 13 illustrate the intermediate slide rail 16 disposed in the fully extended position with respect to the stationary slide rail 12. The interlock 23 engages the first opening 86 and the second opening 87 (defined by the inner flange 192 in one embodiment) to lock or secure the intermediate and stationary slide rails 16, 12 together. When an operator desires to retract the telescoping slide rail assembly of these embodiments of the present invention, such that the mounting slide rail 15 is retracted into the intermediate slide rail 16, the retraction stop 20 is disengaged so that the mounting slide rail 15 moves opposite arrow 300 (see FIG. 2) relative to the intermediate slide rail 16. When the mounting slide rail 15 is disposed nearly at the fully retracted position, the tongue 146 will contact the bearing portion 123 of the arm 22 to disengage the latch mechanism 50 from the first opening 86 and stationary slide rail 12.

Figure 7:
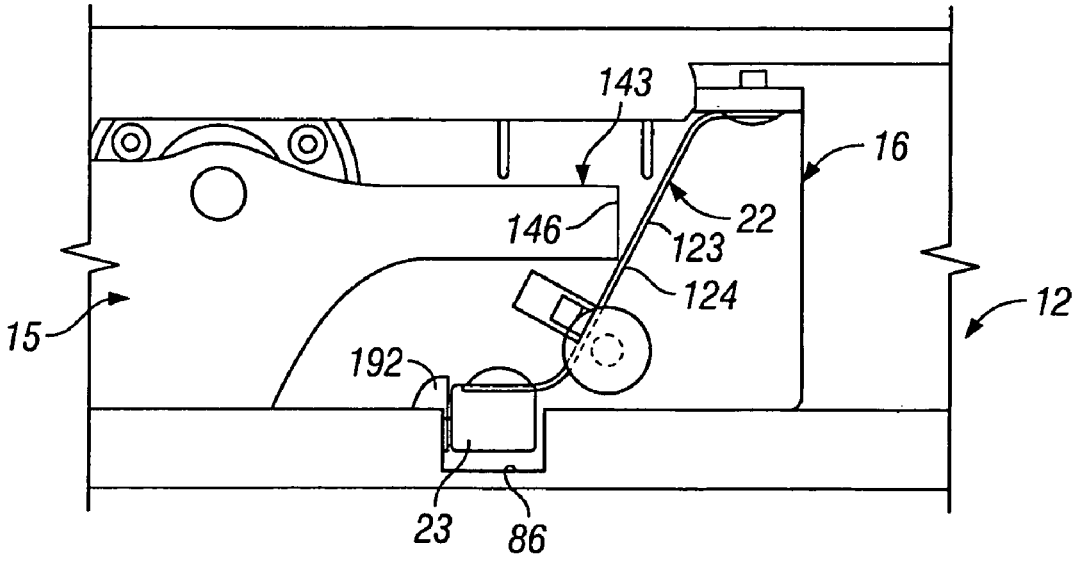
FIG. 7 is a detailed elevation view of the telescoping slide rail assembly of FIG. 6 illustrating a mounting slide rail just prior to disconnecting a latch mechanism.

FIG. 7 illustrates the intermediate slide rail 16 disposed in a fully extended position. The mounting slide rail 15 has been moved from the fully extended position after release of the retraction stop 20. The tab (148, see FIGS. 1 and 4) formed at the free end of the tongue 146 has moved into contact with the bearing portion 123 of the main element 124 on the arm 22.

Figure 8:
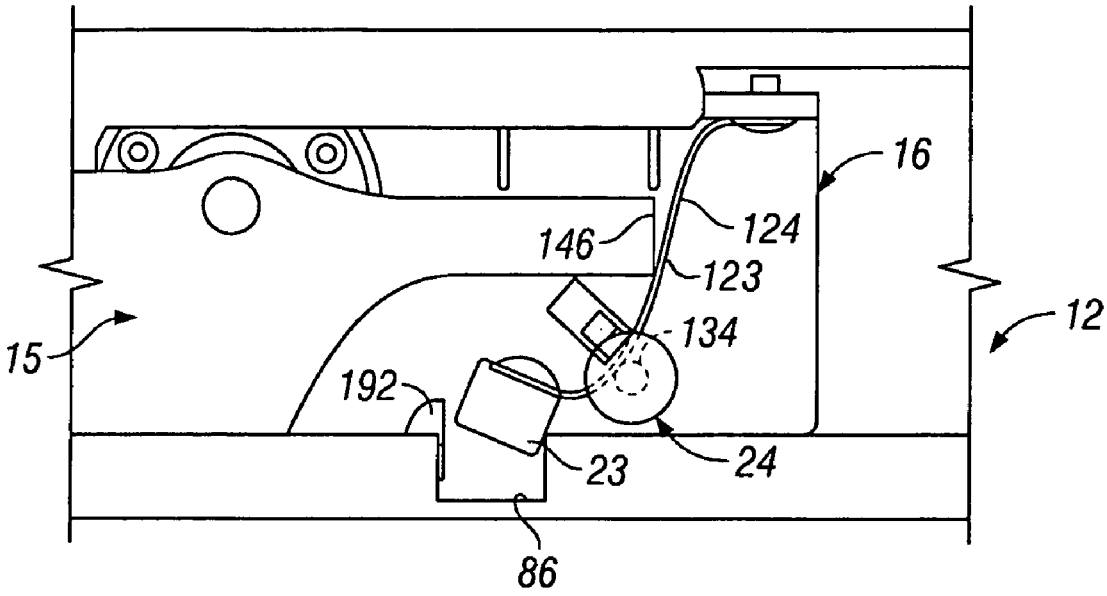
FIG. 8 is a detailed elevation view of the telescoping slide rail assembly of FIG. 7 illustrating the mounting slide rail disconnecting the latch mechanism.

FIGS. 8, 14 and 15 illustrate the further movement of the mounting slide rail 15 with respect to intermediate slide rail 16. The mounting slide rail 15 has been moved inwardly, opposite arrow 300 (see FIG. 2), such that the tab 148 (see FIGS. 1 and 4) formed at the free end of the tongue 146 contacts the bearing portion 123 of the arm 22. In FIG. 8, the tab 148 (see FIGS. 1 and 4) formed at the free end of the tongue 146 moves the bearing portion 123 of the main element 124 into contact with the bearing portion 134 of the stop pivot 24. Because the end of the arm 22 opposite the interlock 23 is fixed and the tab 148 (see FIGS. 1 and 4) formed at the free end of the tongue 146 contacts the bearing portion 123 of the main element 124 between the end fixed at the mount portion and the stop pivot 24, the arm 22 bends such that the interlock 23 moves out of engagement with the first opening 86 and the inner flange 192, i.e. second opening 87. As a result, the intermediate slide rail 16 may then be moved from the fully extended position to the fully retracted position. Likewise in FIGS. 12 and 13, the free end of the tongue 146 is moved inwardly in the direction of the latch arm 22.

In FIGS. 14 and 15, the free end of the tongue 146 passes over the outer end of the arm 22 that defines the hooked finger 158 and the mount portion 150 and contacts the bearing portion 123 and moves the flange 152 in a direction toward the inner end 17 of the intermediate slide rail 16 such that the mount portion 150 rotates about the pin 156 in a direction toward the inner end 17 of the intermediate slide rail 16 against the bias of spring 160 so that the interlock 23 disengages the first opening 86. As a result, the intermediate slide rail 16 may then be moved from the fully extended position to the fully retracted position. One particular advantage of this embodiment is a robust engagement of the first opening which does not fail. Another advantage is exceptional operational reliability.

Figure 9:
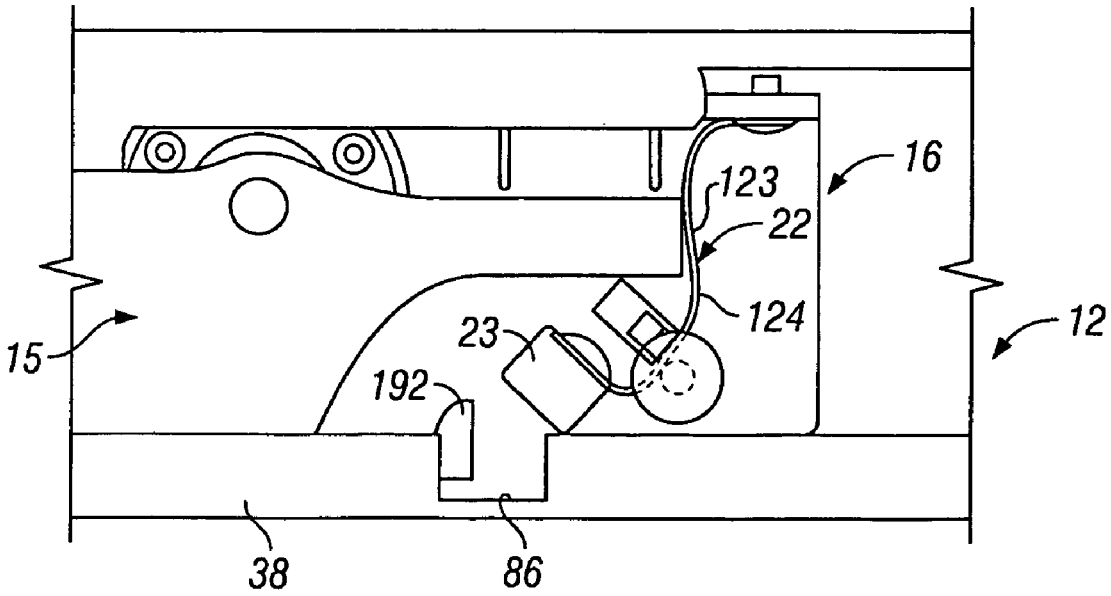
FIG. 9 is a detailed elevation view of the telescoping slide rail assembly of FIG. 8 illustrating the latch mechanism disconnected.

FIG. 9 illustrates the intermediate slide rail 16 moved from the fully extended position relative to the stationary slide rail 12. The interlock 23 has been moved out of engagement with the first opening 86 to permit movement of the intermediate slide rail 16 to the fully retracted position. The arm 22 remains bowed and the main element 124 remains in contact with stop pivot 24 such that the interlock 23 is disposed above the lower lip 38.

It will be recognized by those of skill in the art that the element identifiers "stationary", "intermediate" and "mounting", when used in connection with the slide rails, merely serve to identify the different rails rather than strictly defining any of their functions. Other element identifiers may have been first, second and third slide rails. However, those element identifiers were not used in order to eliminate confusion and mistakes in understanding the present invention.

Although the invention has been described in detail with reference to certain preferred embodiments, variations and modifications exist within the scope and spirit of the invention as described and defined in the following claims. For example, the latch arm and interlock may be formed from a single element and use fewer fasteners.

What is claimed is:

1. A telescoping slide rail assembly comprising:

a stationary slide rail and an intermediate slide rail interconnected such that the intermediate slide rail is movable relative to the stationary slide rail to extend and retract between a fully extended position and a fully retracted position;

a mounting slide rail interconnected to the intermediate slide rail for movement relative thereto such that the mounting slide rail extends and retracts relative to the intermediate slide rail between a fully extend position and a fully retracted position;

the intermediate slide rail including a latch mechanism that engages a first opening in the stationary slide rail when the intermediate slide rail is disposed in the fully extended position in order to secure the intermediate slide rail in the fully extended position until the latch mechanism is disengaged; and the latch mechanism including an second opening formed in the intermediate slide rail, an arm having a bearing portion defined on an inner end of the latch arm and an interlock defined on an outer end of the latch arm and a biasing element configured to bias the bearing portion in the direction of an outer end of the intermediate slide rail and disposed such that the interlock engages the first and second openings, when aligned, and prevents unwanted movement of the intermediate slide rail toward the fully retracted position, wherein a tongue defined at an inner end of the mounting slide rail is configured offset from a wall of the mounting slide rail and the tongue is passed over the interlock in order to engage the bearing portion and disengages the latch mechanism by moving the bearing portion in a direction opposite the direction of the outer end of the intermediate slide rail when the mounting slide rail is moved toward the fully retracted position such that the intermediate slide rail will subsequently be moved toward the fully retracted position.

2. The telescoping slide rail assembly as recited in claim 1, wherein the arm has a mount portion connected to the intermediate slide rail, a free end having the interlock disposed thereon extending from one side of the mount portion and a flange defining the bearing portion extending from another side of the mount portion.

3. The telescoping slide rail assembly as recited in claim 1, wherein the intermediate slide rail includes a slide block disposed to reduce friction between the stationary and intermediate slide rails.

4. The telescoping slide rail assembly as recited in claim 1, wherein the latch mechanism is configured as an integral element.

5. The telescoping slide rail assembly as recited in claim 1, wherein the mounting slide rail includes at least one alignment device.

6. The telescoping slide rail assembly as recited in claim 1, wherein the tongue includes a tab disposed at a free end thereof which engages the arm.

7. The telescoping slide rail assembly as recited in claim 2, wherein the tongue contacts the bearing portion to pivot the arm about the mount portion so that the interlock disengages the first opening whereby the intermediate slide rail may be moved toward a fully retracted position.

8. The telescoping slide rail assembly as recited in claim 2, wherein the interlock is configured as a hooked finger which passes through the first opening to contact a wall of the stationary slide rail.

9. The telescoping slide rail assembly as recited in claim 2, wherein the biasing element is a coil spring bearing against the flange at one end and against the intermediate slide rail at another end.

* * * * *